US012800169B2

(12) United States Patent
Hermann et al.

(10) Patent No.: US 12,800,169 B2
(45) Date of Patent: Nov. 17, 2026

(54) DEVICE AND METHOD FOR ANALYZING AND DISCRIMINATING FAULTS IN AN HVAC SYSTEM

(71) Applicant: Carrier Corporation, Palm Beach Gardens, FL (US)

(72) Inventors: Theodore Hermann, Eden Pairie, MN (US); Benjamen Baker, New Haven, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 302 days.

(21) Appl. No.: 18/640,581

(22) Filed: Apr. 19, 2024

(65) Prior Publication Data

US 2024/0353132 A1 Oct. 24, 2024

Related U.S. Application Data

(60) Provisional application No. 63/497,748, filed on Apr. 24, 2023.

(51) Int. Cl.
*F24F 11/38* (2018.01)
*F24F 140/00* (2018.01)
*F24F 140/60* (2018.01)

(52) U.S. Cl.
CPC ..... *F24F 11/38* (2018.01); *F24F 2140/00* (2018.01); *F24F 2140/60* (2018.01)

(58) Field of Classification Search
None
See application file for complete search history.

(56) References Cited

U.S. PATENT DOCUMENTS 9,285,802 B2 3/2016 Arensmeier
9,551,504 B2 1/2017 Arensmeier et al.
9,638,436 B2 5/2017 Arensmeier et al.
(Continued)

FOREIGN PATENT DOCUMENTS

CN 104931284 B 3/2018
CN 105135598 B 9/2018
(Continued)

OTHER PUBLICATIONS

Extended European Search Report received for EP Application No. 24171035.9, mailed on Sep. 18, 2024, 9 Pages.

*Primary Examiner* — Sean Shechtman
(74) *Attorney, Agent, or Firm* — Andrew Goldberg

(57) ABSTRACT

A device for analyzing and discriminating faults in an HVAC system. The device comprises acoustic sensor(s) to monitor acoustic parameters associated with component(s) of the HVAC system, and electrical sensor(s) to monitor one or more electrical parameters associated with the component(s) of the HVAC system. The device comprises a processing unit in communication with the acoustic sensor(s) and the electrical sensor(s). The processing unit is configured to receive, from the acoustic sensor (s), the acoustic parameters being monitored within the HVAC system, receive, from the electrical sensor(s), the electrical parameters associated with the component(s) of the HVAC system, and analyze one or more of the received acoustic parameters, and the electrical parameters to detect and discriminate one or more faults in the component(s) of the HVAC system.

14 Claims, 4 Drawing Sheets

(56) References Cited

U.S. PATENT DOCUMENTS

| | | | | |
|---|---|---|---|---|
| 10,047,970 | B2 | 8/2018 | Nelson et al. | |
| 10,139,122 | B2 | 11/2018 | Blair et al. | |
| 10,139,124 | B2 | 11/2018 | Berg et al. | |
| 10,203,676 | B2 | 2/2019 | Maughan et al. | |
| 10,404,775 | B2 | 9/2019 | Seaton et al. | |
| 10,533,761 | B2 | 1/2020 | Barton et al. | |
| 10,592,821 | B2 | 3/2020 | Denton et al. | |
| 10,677,485 | B2 | 6/2020 | Poluri et al. | |
| 10,677,487 | B2 | 6/2020 | Apsangi | |
| 10,697,658 | B2 | 6/2020 | Lane | |
| 10,698,399 | B2 | 6/2020 | Brownie et al. | |
| 10,845,076 | B2 | 11/2020 | Blair et al. | |
| 10,852,019 | B2 | 12/2020 | Endel et al. | |
| 11,054,164 | B2 | 7/2021 | Costa et al. | |
| 11,162,702 | B2 | 11/2021 | Blair et al. | |
| 11,248,817 | B2 | 2/2022 | Roth | |
| 11,269,320 | B2 | 3/2022 | Kerbel et al. | |
| 11,391,479 | B2 | 7/2022 | Picardi et al. | |
| 2008/0033600 | A1 | 2/2008 | Norbeck | |
| 2014/0266755 | A1 | 9/2014 | Arensmeier et al. | |
| 2015/0319524 | A1* | 11/2015 | Wang | G01S 15/42 381/92 |
| 2016/0327304 | A1* | 11/2016 | Tsuji | F24F 11/62 |
| 2018/0012479 | A1 | 1/2018 | Seaton et al. | |
| 2020/0049364 | A1* | 2/2020 | Nakamura | F24F 11/38 |
| 2022/0268469 | A1 | 8/2022 | Delgoshaei et al. | |
| 2022/0282897 | A1 | 9/2022 | Gopalnarayanan et al. | |
| 2022/0381463 | A1 | 12/2022 | Delgoshaei et al. | |
| 2022/0412589 | A1 | 12/2022 | Palmer et al. | |

FOREIGN PATENT DOCUMENTS

| | | | |
|---|---|---|---|
| CN | 106016578 | B | 3/2019 |
| CN | 105115119 | B | 5/2019 |
| CN | 108954668 | B | 10/2020 |
| CN | 111797136 | A | 10/2020 |
| CN | 110671789 | B | 2/2021 |
| CN | 113007853 | A | 6/2021 |
| CN | 214841529 | U | 11/2021 |
| CN | 113891228 | A | 1/2022 |
| CN | 215809182 | U | 2/2022 |
| CN | 113294888 | B | 4/2022 |
| CN | 114528979 | A | 5/2022 |
| CN | 115264748 | A | 11/2022 |
| CN | 115264749 | A | 11/2022 |
| DE | 102019218080 | A1 | 5/2021 |
| EP | 3258183 | A1 | 12/2017 |
| WO | 2022149597 | A1 | 7/2022 |

* cited by examiner

DEVICE AND METHOD FOR ANALYZING AND DISCRIMINATING FAULTS IN AN HVAC SYSTEM

CROSS-REFERENCE TO RELATED APPLICATION

This patent application claims the benefit of U.S. Provisional Patent Application No. 63/497,748, filed on Apr. 24, 2023, which is incorporated by reference herein in its entirety.

BACKGROUND

Embodiments described herein relate to the field of fault detection systems, and more particularly, to faults in a heating, ventilation, and air conditioning (HVAC) system.

HVAC system failures may often occur without warning leading to customer dissatisfaction and having to endure a lack of comfort while waiting for a service technician to arrive, diagnose, and repair the problem. Fault detection systems may be employed in the HVAC system to detect fault conditions in the HVAC system. However, the existing fault detection system may not be reliable as they fail to discriminate and identify the actual cause of the fault in the HVAC system.

SUMMARY

Described herein is a device for analyzing and discriminating faults in an HVAC system. The device comprises one or more first sensors operable to monitor one or more acoustic parameters associated with one or more components of the HVAC system, and one or more second sensors operable to monitor one or more electrical parameters associated with the one or more components of the HVAC system. The device further comprises a processing unit in communication with the one or more first sensors and the one or more second sensors. The processing unit comprises a processor coupled to a memory storing instructions executable by the processor. The processing unit is configured to receive, from the one or more first sensors, the one or more acoustic parameters being monitored within the HVAC system, receive, from the one or more second sensors, the one or more electrical parameters associated with the one or more components of the HVAC system, and analyze one or more of the received acoustic parameters, and the electrical parameters to detect and discriminate one or more faults in the one or more components of the HVAC system.

In one or more embodiments, the processing unit is configured to compare the received electrical parameters with predetermined threshold values and analyze the received acoustic parameters and the electrical parameters when the electrical parameters exceed the predetermined threshold values, to detect and discriminate the one or more faults in the one or more component.

In one or more embodiments, the processing unit is configured to match the received acoustic parameters and the received electrical parameters with pre-stored acoustic parameters and pre-stored electrical parameters respectively associated with one or more known fault conditions, and correspondingly detect and discriminate the one or more faults in the one or more component(s) upon a positive matching.

In one or more embodiments, the one or more acoustic parameters comprise acoustic signatures associated with at least one of fire, gas flow, and electrical discharge in any of an audible range, ultrasonic range, and time/frequency domain.

In one or more embodiments, the one or more electrical parameters comprise one or more of current draw, capacitance, voltage, power, and back electromotive force (EMF) associated with the one or more components.

In one or more embodiments, the one or more components associated with the HVAC system comprise one or more of a gas forced air furnace motor, a gas supply valve, a combustion air motor associated with a furnace, an indoor fan motor, an ignition system of the furnace, and an HVAC control board.

In one or more embodiments, the device comprises an alert generation unit in communication with the processing unit, wherein the processing unit transmits a set of alert signals to the alert generation unit upon detection of the one or more faults in the HVAC system.

In one or more embodiments, the device is configured to transmit a set of alert signals to one or more mobile devices associated with one or more users upon detection of the one or more faults in the HVAC system.

In one or more embodiments, the device is in communication with a controller associated with the one or more component(s) of the HVAC system, wherein upon detection of the one or more faults in the HVAC system, the device transmits a set of control signals to the controller to stop the operation of the one or more faulty components without stopping the operation of the HVAC system, or to stop the operation of the HVAC system.

In one or more embodiments, the one or more first sensors is an acoustic sensor comprising a micro-electro-mechanical system (MEMS) based microphone.

In one or more embodiments, the one or more second sensors is an electrical sensor comprising one or more of a current sensor, a voltage sensor, a capacitance sensor, and an electrical power sensor.

Also described herein is a method for analyzing and discriminating faults in an HVAC system, the method comprising the steps of monitoring and receiving one or more acoustic parameters associated with one or more components of the HVAC system, monitoring and receiving one or more electrical parameters associated with the one or more components of the HVAC system, and analyzing one or more of the received acoustic parameters, and the received electrical parameters to detect and discriminate one or more faults in the one or more component of the HVAC system.

In one or more embodiments, the method comprises the steps of comparing the received electrical parameters with predetermined threshold values, and analyzing the received acoustic parameters and the received electrical parameters when the electrical parameters exceed the predetermined threshold values, to detect and discriminate the one or more faults in the one or more components.

In one or more embodiments, the method comprises the steps of matching the acoustic parameters and the electrical parameters with pre-stored acoustic parameters and pre-stored electrical parameters respectively associated with one or more known fault conditions, and correspondingly detecting and discriminating the one or more faults in the one or more components upon a positive matching.

In one or more embodiments, the method comprises the steps of transmitting a set of alert signals to an alert generation unit upon detection of the one or more faults in the HVAC system.

In one or more embodiments, the method comprises the steps of transmitting a set of alert signals to one or more mobile devices associated with one or more users upon detection of the one or more faults in the HVAC system.

In one or more embodiments, upon detection of the one or more faults in the HVAC system, the method comprises the steps of transmitting a set of control signals to the controller to stop the operation of the one or more faulty components without stopping the operation of the HVAC system, or to stop the operation of the HVAC system.

In one or more embodiments, the one or more acoustic parameters comprise acoustic signatures associated with at least one of fire, gas flow, and electrical discharge in any of an audible range, ultrasonic range, and time/frequency domain.

The foregoing summary is illustrative only and is not intended to be in any way limiting. In addition to the illustrative aspects, embodiments, and features described above, further aspects, embodiments, features, and techniques of the invention will become more apparent from the following description taken in conjunction with the drawings.

BRIEF DESCRIPTION OF THE DRAWINGS

The accompanying drawings are included to provide a further understanding of the subject disclosure of this invention and are incorporated in and constitute a part of this specification. The drawings illustrate exemplary embodiments of the subject disclosure and, together with the description, serve to explain the principles of the subject disclosure.

In the drawings, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION

Figure 1:
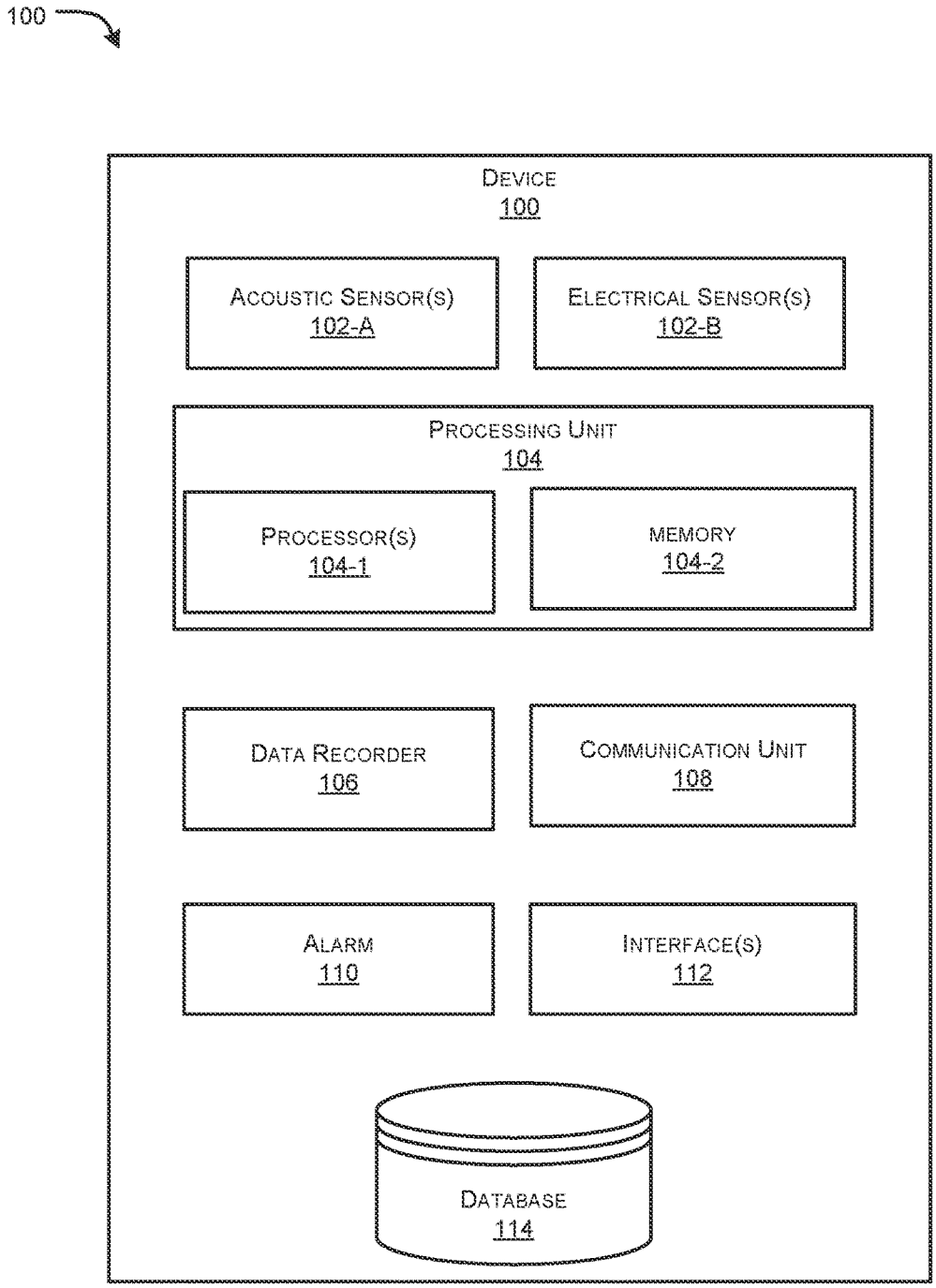
FIG. 1 illustrates an exemplary block diagram of a device for analyzing and discriminating faults in a heating, ventilation, and air conditioning (HVAC) system in accordance with one or more embodiments of the disclosure.

The following is a detailed description of embodiments of the disclosure depicted in the accompanying drawings. The embodiments are described in such detail as to clearly communicate the disclosure. However, the amount of detail offered is not intended to limit the anticipated variations of embodiments; on the contrary, the intention is to cover all modifications, equivalents, and alternatives falling within the spirit and scope of the subject disclosure as defined by the appended claims.

Various terms are used herein. To the extent a term used in a claim is not defined below, it should be given the broadest definition persons in the pertinent art have given that term as reflected in printed publications and issued patents at the time of filing.

In the specification, reference may be made to the spatial relationships between various components and to the spatial orientation of various aspects of components as the devices are depicted in the attached drawings. However, as will be recognized by those skilled in the art after a complete reading of the subject disclosure, the components of this invention, described herein may be positioned in any desired orientation. Thus, the use of terms such as "above," "below," "upper," "lower," "first", "second" or other like terms to describe a spatial relationship between various components or to describe the spatial orientation of aspects of such components should be understood to describe a relative relationship between the components or a spatial orientation of aspects of such components, respectively, as the device, the HVAC system, the components of the HVAC system, sensor(s), processing unit, and corresponding components, described herein may be oriented in any desired direction.

Heating, ventilation, and air conditioning (HVAC) systems typically include a condenser unit and an air handling unit (evaporator) comprising heat exchangers, coils, blowers, fans, thermostats, air filters, and the like to provide a controlled flow of conditioned air and ventilation in a space. In addition, the HVAC system may also include a furnace comprising an ignition system and a blower for heating and supplying hot or warm air to the space. Further, an HVAC control box or panel may be implemented that may control the operation and switch of loads/equipment such as a blower motor and an igniter associated with the furnace, and a fan motor and a pump associated with the chiller unit and air handling unit.

HVAC system failures may often occur without warning leading to customer dissatisfaction and having to endure a lack of comfort while waiting for a service technician to arrive, diagnose, and repair the problem. For instance, the HVAC control box switches these high-power components of the HVAC system which may cause a thermal event if an electrical discharge or arc is generated in these components during the switching operation. In addition, the mechanical parts associated with the blowers, motors, and gas valves may also wear out which may lead to system fault without any warning. Further, a carbon buildup on the flame sensor rod, bad igniter, or loss of gas supply in the ignition system may also lead to heating system failure without any warning, which may also be fatal and also lead to significant costs sunk in the investigation, warranty, and liability claims.

Fault detection systems are generally employed in the HVAC system to detect fault conditions. For instance, monitoring of electric parameters such as current draw, capacitance, and back EMF associated with the component of the HVAC system may be employed to indirectly identify wear-out and failure modes in the HVAC system. However, one drawback of using electrical parameters alone as a diagnostic/prognostic tool is a possible lack of discrimination between common failure modes. For example, a current draw or motor spin-down electrical signature of a compromised motor bearing, and a squirrel cage impediment may look similar and are difficult to discriminate to identify the actual fault cause. Similarly, carbon build-up on the flame sense rod and a bad igniter may all provide common electrical parameters that may result in an HVAC safety shutdown without the ability of the system to discriminate the actual cause. There is therefore a need to provide a reliable and efficient solution for the detection and discrimination of fault modes in the component of the HVAC system, which may also alert service and safety personnel about a potential safety hazard situation and trigger a service call.

This invention provides an efficient, reliable, and compact device and a method for detecting, analyzing, and discriminating fault events and potential safety hazard situations in an HVAC system. This invention also alerts service and safety personnel about a potential fault condition and safety hazard situation and also triggers a service call. This invention also either shuts down the faulty component or the overall HVAC system in an event of the detection of a potential system failure that may lead to a safety hazard situation.

Figure 2A:
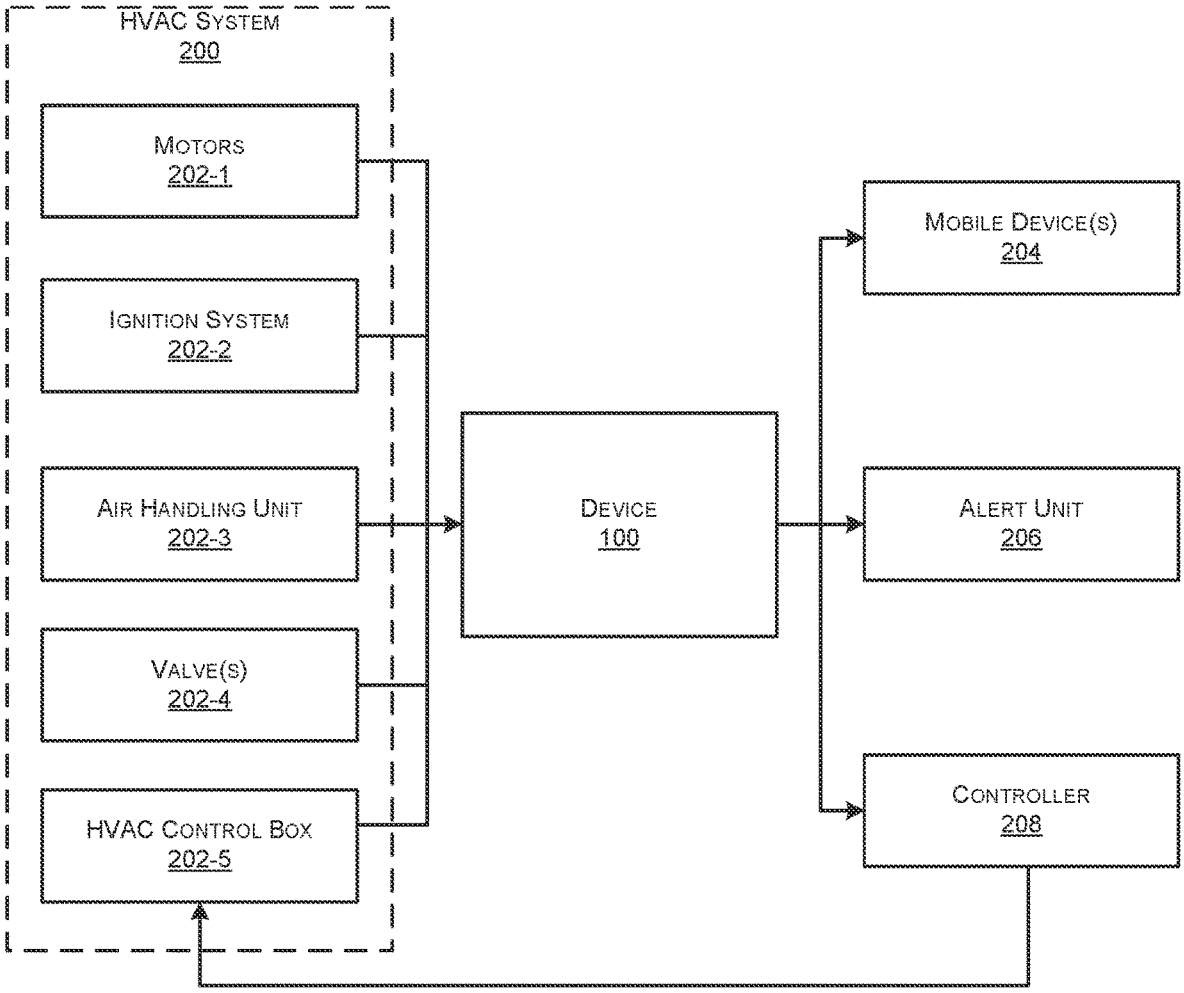
FIG. 2A illustrates an exemplary network architecture where the device is connected to the HVAC system, and mobile devices and an alert generation unit to mitigate the detected faults in the HVAC system in accordance with one or more embodiments of the disclosure
Figure 2B:
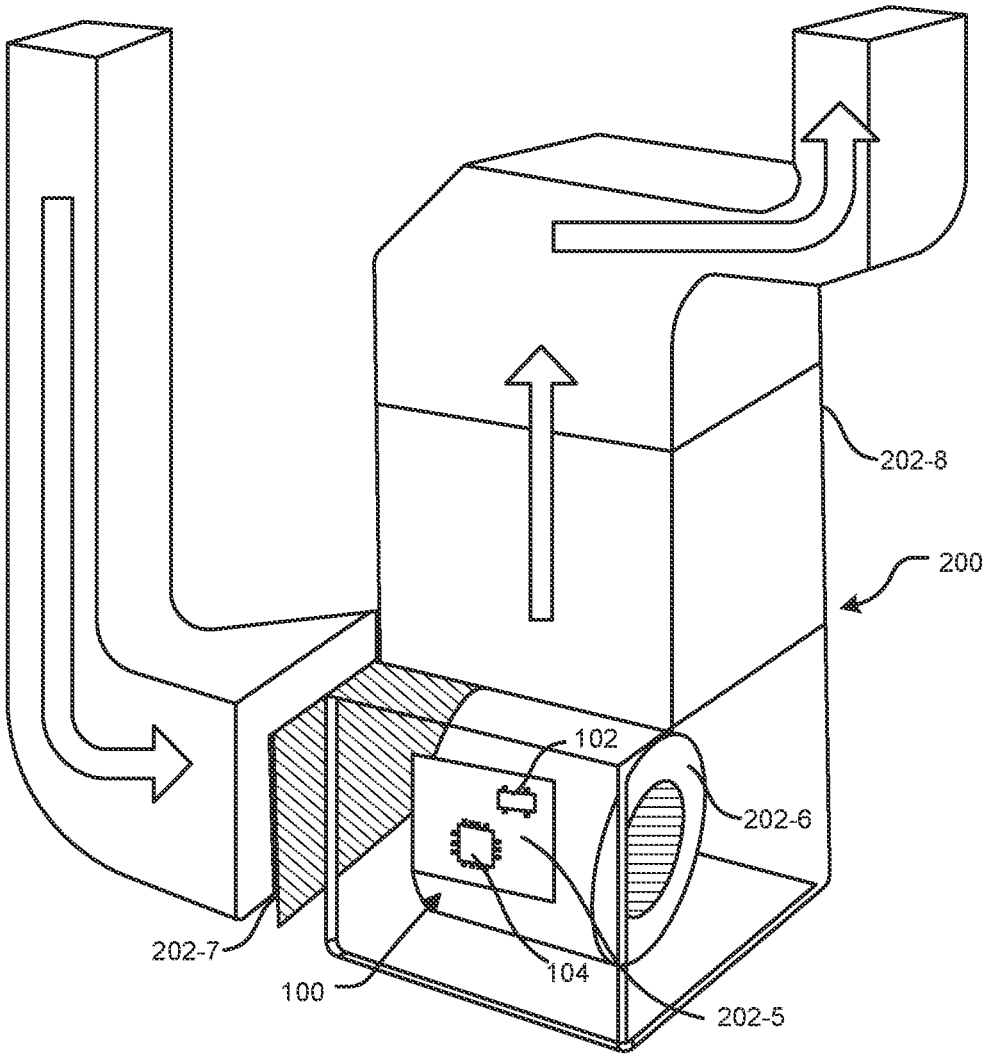
FIG. 2B illustrates an exemplary view depicting the device of FIG. 1 being installed within the HVAC system in accordance with one or more embodiments of the disclosure.

Referring to FIGS. 1 and 2A, the device 100 for the detection, analysis, and discrimination of fault events in one or more components 202-1 to 202-8 (collectively designated as 202, herein) of an HVAC system 200 is illustrated. The device 100 includes one or more sensors 102 comprising one or more acoustic sensor(s) 102-A (also referred to as first sensors 102-A, herein) operable to detect and monitor one or more acoustic parameters associated with one or more components 202 of the HVAC system 200. The acoustic sensors 102-A may be a micro-electro-mechanical system (MEMS) based microphone but is not limited to the like. The acoustic parameters monitored by the acoustic sensors 102-A may be acoustic signatures associated with one or more of fire, gas flow, and electrical discharges, in any of an audible range, ultrasonic range, and time/frequency domain. The device 100 may further include one or more electrical sensors 102-B (also referred to as second sensors 102-B, herein) operable to monitor one or more electrical parameters associated with the components 202 of the HVAC system 200. The electrical parameters may comprise one or more of current drawn, capacitance, voltage, power, and back electromotive force (EMF) associated with the components of the HVAC system 200. The electrical sensors 102-B may comprise one or more of a current sensor, a voltage sensor, a capacitance sensor, and an electrical power sensor, but is not limited to the like. In one or more embodiments, as shown in FIGS. 2A and 2B, the components 202 associated with the HVAC system 200 may comprise one or more of motors 202-1, an ignition system 202-2, an air handling unit 202-3, a gas supply valve 202-4, and an HVAC control box 202-5. The components 202 may specifically include a combustion air motor associated with the furnace 202-8, an indoor fan motor, a blower 202-6, and an ignition device (hot surface ignitor or sparker) of the ignition system 202-2, but is not limited to the like. As shown in FIG. 2B, in one or more embodiments, the device 100 may be installed over the HVAC control box 202-5 that may be positioned on the blower 202-6 adjacent to the filter 202-7 of the air handling unit but before the furnace 202-8 to keep the device 100 thermally stable, however, the device 100 may also be installed at other locations within the HVAC system 200, without any limitation.

The device 100 further includes a processing unit 104 which comprises a processor 104-1 coupled to a memory 104-2 in which instructions executable by the processor 104-1 are stored. The processing unit 104 is configured to receive the acoustic parameters being monitored within the HVAC system 200, and also to receive the one or more electrical parameters associated with the HVAC system 200. The processing unit 104 may analyze one or more of the received acoustic parameters, and the received electrical parameters to detect and discriminate one or more faults in the components of with the HVAC system 200. In one or more embodiments, the processing unit 104 matches the received acoustic parameters and the received electrical parameters with pre-stored acoustic parameters and pre-stored electrical parameters, respectively, associated with one or more known fault conditions, and correspondingly detects and discriminates one or more faults in the one or more components upon a positive match. Initially, the processing unit 104 may compare the received electrical parameters with predetermined threshold values. Further, the processing unit 104 may analyze the received acoustic parameters in addition to the electrical parameters to detect and discriminate one or more faults in the components 202, when the electrical parameters exceed the predetermined threshold values.

In an example, the monitored electrical parameters associated with the motor 202-1 of the HVAC system 200 may indicate that the motor 202-1 may be faulty, however, the fault in the motor 202-1 may be because of squirrel cage impediment and/or motor bearing wear, which may not be distinguished using the electrical parameters of the motor 202-1. To overcome this motor fault discrimination issue, the processing unit 104 may monitor the electrical parameters such as current draw or motor spin down associated with the motor 202-1 of the HVAC system 200. Further, if the monitored electrical parameters are identified to be outside a predetermined threshold range or envelope, the processing unit 104 may then analyze the acoustic parameters of the motor in addition to the electrical parameters of the motor 202-1 to discriminate the fault causes, as a squirrel cage impediment of the motor 202-1 may have a very different acoustic signature than a motor bearing wear. Thus, in the event of a wear-out condition in the motors 202-1, the device 100 can identify the cause of fault in the motor 202-1 in advance and may warn before the faulty motor is compromised.

In another example, the monitored electrical parameters associated with the ignition system 202-2 of the furnace may indicate that a proper ignition sequence may have been executed, however, the expected flame signals (acoustic signature of flame) that are generally generated during the ignition sequence may not be actually generated. This may happen repeatedly resulting in loss of heating in the space until the ignition system 202-2 may be serviced. The root causes for ignition system 202-2 failure may include carbon build-up on the flame sense rod, bad igniter, or lack of gas supply. To overcome this ignition system fault discrimination issue, the processing unit 104 of the device 100 may analyze the acoustic parameters of the ignition system 202-2 in addition to the electrical parameters of the ignition system 202-2 to discriminate the fault causes in the ignition system 202-2, as the acoustic signature of gas flow, ignition (hot spark applications), and combustion are unique and distinguishable. Thus, in the event of an ignition system failure condition in the HVAC system 200, the device 100 can identify the cause of fault in advance and may warn before the faulty ignition system and safety are compromised.

The device 100 may be installed at desired positions within the HVAC system 200, which allows the acoustic sensor(s) 102-A to monitor the acoustic spectrum generated within the HVAC system 200 and allows the electrical sensor(s) 102-B to monitor electrical parameters associated with the components 202 of the HVAC system 200. Further, the acoustic sensor(s) and the electrical sensor(s) 102-B may be operatively connected to the processing unit 104 via a wired media. In one or more embodiments, the acoustic sensor(s) 102-A and electrical sensor(s) 102-B remain in communication with the processing unit 104 via wireless media, through a network. The components of the device 100 may be safely enclosed in a fire-safe casing to prevent the device 100 from getting damaged by fire.

The device 100 further includes a data recorder 106 that stores log data comprising one or more of the acoustic spectrums being detected within the HVAC control box 202-5, the electrical parameters monitored by the electrical sensors 102-B, and the corresponding detected fault events and their time stamp and duration. The data recorder 106 may be secured within a casing/housing of the device 100 along with the acoustic sensor(s) 102-A, electrical sensor(s) 102-B, and the processing unit 104. In one or more embodiments, the data recorder 106 may be secured outside the HVAC system 200. Further, the data recorder 106 may be operatively connected to the processing unit 104 via wired media. In one or more embodiments, the data recorder 106 may remain in communication with the processing unit 104 via wireless media, through a network.

The device 100 further includes a communication unit 108 (such as a transceiver 108), and an alert generation unit (alarm) 110 being configured within a single housing along with the processing unit 104, sensor(s), and data recorder 106, which can be easily positioned at a predefined location within the HVAC system 200. The processing unit 104 may be operatively coupled to the sensor(s), the data recorder 106, the transceiver 108, the alarm 110. A processor 104-1 and a memory 104-2 collectively form the processing unit 104, where the processor 104-1 includes suitable logic, circuitry, and/or interfaces that are operable to execute one or more instructions stored in the memory 104-2 to perform predefined operations. The memory 104-2 may be operable to store one or more instructions. The processor 104-1 may be implemented using the processors known in the art. Some of the commonly known memory implementations include, but are not limited to, a random access memory (RAM), a read only memory (ROM), a hard disk drive (HDD), and a secure digital (SD) card. Further, the memory includes the one or more instructions that are executable by the processor to perform specific operations. It is apparent to a person having ordinary skills in the art that the one or more instructions stored in the memory enable the hardware of the device 100 to perform the predefined operations.

A database 114 associated with the device 100 is pre-stored with the list of pre-stored acoustic parameters and pre-stored electrical parameters respectively associated with one or more known fault conditions, the predetermined threshold values of the electrical parameters and acoustic parameters, along with the severity level of the fault conditions. In one or more embodiments, the database 114 can be associated with the device 100 and reside in the same device 100 for offline operation. In other embodiments, the database 114 can be associated with a central server that remains in communication with the processing unit 104 of the device 100.

The device 100 also comprises an interface(s) 112 that may comprise a variety of interfaces, for example, interfaces for connecting the device 100 to a power source or to the HVAC control box 202-5, and interfaces 112 for data input and output device 100*s* such as the data recorder 106 and a display referred to as I/O device 100*s*, storage device 100*s*, and the like. The device 100 further includes the communication unit 108 that may be a Wi-Fi® module, transceiver, Bluetooth module, cellular connection module such as 2G, 3G, 4G, and 5G, and the like to facilitate communication of the device 100 with a fire system or alarm system 206 of a location where the HVAC system 200 is installed, and one or more mobile devices 204 associated with users, and safety and service personnel of the invention, a central server through the network, and the HVAC control box 202-5 of the HVAC system 200 through a controller 208. The mobile devices 204 may include smartphones, laptops, tablets, hand-held computing devices, computers, and the like. The interface(s) may also provide a communication pathway for one or more internal components or units of the device 100. Examples of such internal components include, but are not limited to, the sensor(s), processing unit 104, database, and alarm 110 of the device 100.

In one or more embodiments, the processing unit 104 may be configured to transmit a set of alert signals to the alert generation unit (alarm) 110 of the device 100 upon detection or estimation of one or more faults in the components of the HVAC system 200. The device 100 may further transmit the set of alert signals to the mobile devices 204 of the users or to the fire detection and alarm system 206 of the location where the HVAC system 200 is installed, to trigger a service and/or safety call, which may help mitigate a fire hazard or fault event.

In one or more embodiments, upon detection or estimation of one or more fault events within the HVAC system 200, the device 100 may be configured to transmit a set of control signals to the controller 208 that may actuate the HVAC control box 202-5 to stop the operation of the overall HVAC system 200 or to stop the operation of just the faulty component 202 without affecting the operation of other healthy components of the HVAC system 200. This may help stop the operation of the HVAC system 200 and/or faulty components to avoid further damage to the HVAC system 200 and corresponding components 202.

Accordingly, the device's 100 capability to identify and accurately discriminate the cause of fault in the components 202 of the HVAC system 200, can aid in the determination of a potential hazard situation and also eliminate false triggering of the device 100.

The communication unit 108 (transceiver) enables the processing unit 104 to receive the captured/detected acoustic parameters from the acoustic sensors 102-A and the captured/detected acoustic parameters from the electrical sensors 102-B for further analysis and detection of the fault events. Further, the communication unit 108 enables the device 100 to transmit and store the recorded log data in the data recorder 106 and further enables the device 100 to transmit the stored log data from the data recorder 106 to the central server, the mobile devices 204 of the users, and the safety and service personnel for diagnostic and prognostic purposes. The communication unit 108 also enables the device 100 to transmit alert signals to the mobile devices 204 of the users or to the fire detection and alarm system of the location where the HVAC system 200 is installed, to trigger a service and/or safety call. Furthermore, the communication unit 108 enables the device 100 to transmit control signals to the controller 208 that enables the HVAC control box 202-5 to stop the operation of the HVAC system 200 and/or the faulty components 202 to avoid further damage to the HVAC system 200 and corresponding components. Examples of the transceiver 108 may include, but are not limited to, an antenna, an Ethernet port, an USB port, or any other port that can be configured to transmit the captured data. The transceiver transmits data in accordance with the various communication protocols, such as TCP/IP, UDP, and 2G, 3G, or 4G communication protocols.

The alert generation unit (alarm) 110 of the device 100 includes an LED, a siren, and/or a buzzer. The device 100 upon detection of a fault within the HVAC system 200 triggers the alarm 110 of the device 100 or the fire detection and alarm system of the location where the HVAC control box 202-5 is installed to alert about the detected electrical discharge and a potential fire hazard situation. The device 100 further includes a power source such as a battery that is within the housing of the device 100 to supply electrical power to the components of the device 100. Besides, the device 100 may also be electrically connected to a power source of the HVAC control box 202-5 or the HVAC system 200.

Figure 3:
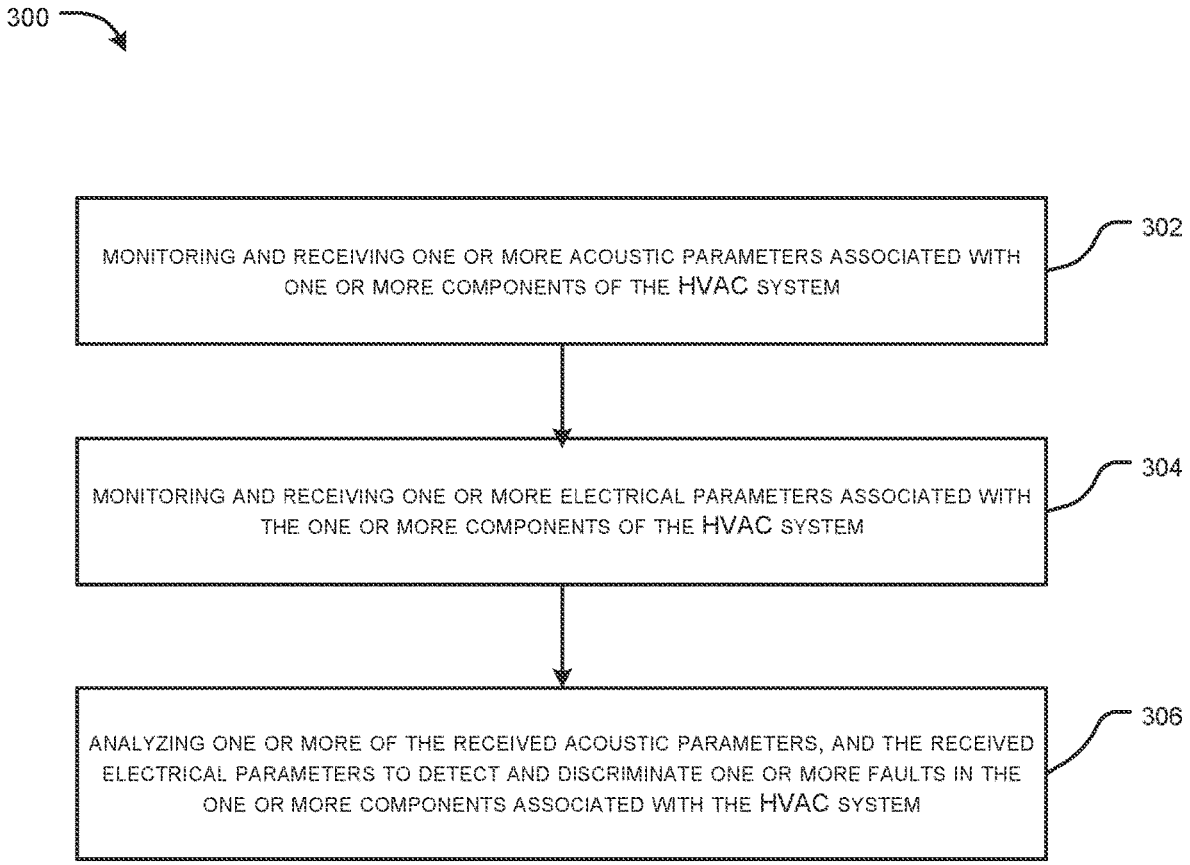
FIG. 3 illustrates an exemplary flow diagram of a method for analyzing and discriminating faults in the HVAC system in accordance with one or more embodiments of the disclosure.

Referring to FIG. 3, an exemplary flow diagram of method 300 for analyzing and discriminating faults in an HVAC system is disclosed. Method 300 comprises step 302 of monitoring and receiving one or more acoustic parameters including acoustic signatures associated with one or more components of the HVAC system using one or more acoustic sensors including, but not limited to, a micro-electro-mechanical system (MEMS) based ultrasonic microphone. The acoustic parameters may comprise acoustic signatures associated with at least one of fire, gas flow, and electrical discharge in any of an audible range, ultrasonic range, and time/frequency domain.

Method 300 further comprises step 304 of monitoring and receiving one or more electrical parameters associated with one or more components of the HVAC system using one or more electrical sensors including, but not limited to, a current sensor, a voltage sensor, a capacitance sensor, and an electrical power sensor. The electrical parameters may comprise one or more of current drawn, capacitance, voltage, power, and back electromotive force (EMF) associated with one or more of an air furnace motor, a gas supply valve, a combustion air motor associated with a furnace, an indoor fan motor, a blower, an ignition system of the furnace, and an HVAC control board Method 300 further includes step 306 of analyzing one or more of the acoustic parameters received at step 302, and the electrical parameters received at step 304, to detect and discriminate the one or more faults in the components associated with the HVAC system. In one or more embodiments, step 302 may include comparing the received electrical parameters with predetermined threshold values, followed by analyzing the received acoustic parameters and the electrical parameters when the electrical parameters exceed the predetermined threshold values, to detect and discriminate fault in the components. In one or more embodiments, step 306 may include matching the acoustic parameters and the electrical parameters with pre-stored acoustic parameters and pre-stored electrical parameters, respectively, associated with one or more known fault conditions, and correspondingly detecting and discriminating the one or more faults in the component upon a positive match.

In one or more embodiments, method 300 comprises the steps of transmitting a set of alert signals to an alert generation unit of the device or location where the HVAC system 200 is installed, upon detection of the one or more faults in the HVAC system. In one or more embodiments, method 300 further comprises transmitting a set of alert signals to one or more mobile devices associated with one or more users upon detection of the one or more faults within the HVAC system.

In one or more embodiments, upon detection of the one or more faults in the HVAC system, method 300 comprises the steps of transmitting a set of control signals to the controller to stop the operation of faulty components without stopping the operation of the HVAC system or to stop the operation of the HVAC system. This may help stop the operation of the HVAC system and/or faulty components to avoid further damage to the HVAC system and corresponding components.

It should be obvious to a person skilled in the art that while various embodiments and examples of this invention have been elaborated for the use of the device and method of this invention for the faults in an HVAC system, however, the teachings of this invention are equally applicable to other electrical and electronic devices or power electronic devices where fault events may occur, and all such embodiments are well within the scope of this invention.

Thus, this invention overcomes the drawbacks, limitations, and shortcomings associated with existing technologies by providing an efficient, reliable, and compact device and a method for detecting, analyzing, and discriminating fault events and potential safety hazard situations in an HVAC system. In addition, the invention also alerts service and safety personnel about a potential fault condition and safety hazard situation and also triggers a service call. Further, the invention also either shuts down the faulty component or the overall HVAC system in an event of the detection of a potential system failure that may lead to a safety hazard situation, thereby avoiding further damage to the HVAC system and corresponding components.

While the invention has been described with reference to exemplary embodiments, it will be understood by those skilled in the art that various changes may be made and equivalents may be substituted for elements thereof without departing from the scope of the invention as defined by the appended claims. Modifications may be made to adopt a particular situation or material to the teachings of the invention without departing from the scope thereof. Therefore, it is intended that the invention not be limited to the particular embodiment disclosed, but that the invention includes all embodiments falling within the scope of the invention as defined by the appended claims.

In interpreting the specification, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

The invention claimed is:

1. A device for analyzing and discriminating faults in an HVAC system, the device comprising:

one or more first sensors operable to monitor one or more acoustic parameters associated with one or more components of the HVAC system;

one or more second sensors operable to monitor one or more electrical parameters associated with the one or more components of the HVAC system;

a controller associated with the one or more components of the HVAC system; and a processing unit in communication with the one or more first sensors and the one or more second sensors, the processing unit comprising a processor coupled to a memory storing instructions executable by the processor, wherein the processing unit is configured to:

receive, from the one or more first sensors, the one or more acoustic parameters being monitored within the HVAC system;

receive, from the one or more second sensors, the one or more electrical parameters associated with the one or more components of the HVAC system; and responsive to the electrical parameters exceeding predetermined threshold values, analyze one or more of the received acoustic parameters, and the received electrical parameters to detect and discriminate one or more faults in the one or more components of the HVAC system, wherein detecting and discriminating comprises:

comparing the received acoustic parameters and the received electrical parameters with pre-stored acoustic parameters and pre-stored electrical parameters respectively associated with one or more known fault conditions; and wherein responsive to detecting the one or more faults in the HVAC system, the device is configured to transmit a set of control signals to the controller to stop operation of one or more faulty components without stopping operation of the HVAC system.

2. The device of claim 1, wherein the one or more acoustic parameters comprise acoustic signatures associated with at least one of fire, gas flow, and electrical discharge in any of an audible range, ultrasonic range, and time/frequency domain.

3. The device of claim 1, wherein the one or more electrical parameters comprise one or more of current drawn, capacitance, voltage, power, and back electromotive force (EMF) associated with the one or more components.

4. The device of claim 1, wherein the one or more components associated with the HVAC system comprise one or more of a gas forced air furnace motor, a gas supply valve, a combustion air motor associated with a furnace, an indoor fan motor, an ignition system of the furnace, and an HVAC control board.

5. The device of claim 1, wherein the device comprises an alert generation unit in communication with the processing unit, wherein the processing unit transmits a set of alert signals to the alert generation unit upon detection of one or more faults in the HVAC system.

6. The device of claim 1, wherein the device is configured to transmit a set of alert signals to one or more mobile devices associated with one or more users upon detection of the one or more faults in the HVAC system.

7. The device of claim 1, wherein the one or more first sensors are an acoustic sensor comprises a micro-electromechanical system (MEMS) based microphone.

8. The device of claim 1, wherein the one or more second sensors are an electrical sensor comprising one or more of a current sensor, a voltage sensor, a capacitance sensor, and an electrical power sensor.

9. A method for analyzing and discriminating faults in an HVAC system, the method comprising the steps of:

monitoring and receiving one or more acoustic parameters associated with one or more components of the HVAC system;

monitoring and receiving one or more electrical parameters associated with the one or more components of the HVAC system;

responsive to the electrical parameters exceeding predetermined threshold values;

analyzing one or more of the received acoustic parameters and the received electrical parameters to detect and discriminate one or more faults in the one or more components of the HVAC system, wherein detecting and discriminating comprises:

comparing the received acoustic parameters and the received electrical parameters with pre-stored acoustic parameters and pre-stored electrical parameters respectively associated with one or more known fault conditions; and wherein responsive to detecting the one or more faults in the HVAC system, transmitting a set of control signals to a controller to stop operation of one or more faulty components without stopping operation of the HVAC system.

10. The method of claim 9, wherein the method comprises the steps of transmitting a set of alert signals to an alert generation unit upon detection of the one or more faults in the HVAC system.

11. The method of claim 9, wherein the method comprises the steps of transmitting a set of alert signals to one or more mobile devices associated with one or more users upon detection of the one or more faults in the HVAC system.

12. The method of claim 9, wherein the one or more acoustic parameters comprise acoustic signatures associated with at least one of fire, gas flow, and electrical discharge in any of an audible range, ultrasonic range, and time/frequency domain.

13. The method of claim 9, wherein the one or more electrical parameters comprise one or more of current drawn, capacitance, voltage, power, and back electromotive force (EMF) associated with the one or more component.

14. The method of claim 9, wherein the one or more components associated with the HVAC system comprise one or more of an air furnace motor, a gas supply valve, a combustion air motor associated with a furnace, an indoor fan motor, a blower, an ignition system of the furnace, and an HVAC control board.

* * * * *